United States Patent [19]

Brown

[11] 4,005,298

[45] Jan. 25, 1977

[54] ELECTRICALLY CONDUCTIVE MOVEABLE SUPPORT MEMBER FOR USE IN ELECTRICAL SWITCHES

[75] Inventor: Jack M. Brown, Costa Mesa, Calif.

[73] Assignee: Esterline Electronics Corporation, Costa Mesa, Calif.

[22] Filed: May 19, 1975

[21] Appl. No.: 578,387

[52] U.S. Cl. ..... 200/153 R; 174/69; 200/275; 200/DIG. 45

[51] Int. Cl.[2] ..... H01H 3/00

[58] Field of Search ... 174/69; 200/153 R, DIG. 45, 200/275, 237; 74/89.2; 335/205, 206, 207

[56] References Cited

UNITED STATES PATENTS

| | | | |
|---|---|---|---|
| 3,300,572 | 1/1967 | Dahlgren et al. | 174/69 |
| 3,459,880 | 8/1969 | Erdle | 174/69 |
| 3,688,063 | 8/1972 | Bell | 200/DIG. 45 |

*Primary Examiner*—Gerald P. Tolin
*Attorney, Agent, or Firm*—Harvey C. Nienow

[57] ABSTRACT

An electrically conductive moveable support member for use as a contact carrier, contactor or armature support.

Such electrically conductive support member is formed of electrically conductive material of sufficient cross section to carry the desired current, and is formed with reverse convolutions which may be interleaved to provide a small, compact, support member. The convolutions are formed about the mid-point of the length of the material, to leave opposite end portions, one of which may be supported to a base member and the other of which is provided with a contactor, armature or the like.

6 Claims, 5 Drawing Figures

ELECTRICALLY CONDUCTIVE MOVEABLE SUPPORT MEMBER FOR USE IN ELECTRICAL SWITCHES

The present invention relates generally to electrically conductive support members for use in electrical switches and the like, and more particularly to such support members as used for contactors, armatures and the like.

Not infrequently, in the designing and manufacturing of electrical switches, such as electromagnetic relays, it is desirable, if not necessary, to conduct electrical energy to a moveable member such as a contactor or armature. It is difficult to provide electrical current flow to such members, and it is also difficult to properly, but moveably, mount the element in its proper position.

Ideally, the support member should be the current carrier, but the electrical requirements are somewhat adverse to the mechanical requirements such that, heretofore, any such combination has been less than successful. Whereas, for electrical purposes, the support member must be sufficiently large to carry the desired current, it must be such as to provide a very soft, minimum friction support for the moveable member. Good current carriers do not exhibit the proper mechanical flexibility, particularly over frequent and numerous flexures, to enable the various functions to be derived from a single element.

With these shortcomings in mind, it is an object of the present invention to provide an electrically conductive moveable support member for electrical switches which has a sufficient cross section to carry the desired current and which can be mounted in a cantilevered position for supporting a moveable member.

Another object of the present invention is to provide an electrically conductive moveable support member as characterized above which provides a substantially frictionless movement and hence will not fail for reasons of mechanical fatigue and the like.

An even further object of the present invention is to provide an electrically conductive moveable support member as characterized above which is formed with a pair of substantially equal but opposite convolutions throughout at least a portion of its length.

An even further object of the present invention is to provide an electrically conductive moveable support member as characterized above which is compact and relatively small due to the fact that the reverse convolutions are interleaved.

Another object of the present invention is to provide an electrically conductive moveable support member as characterized above which is simple and inexpensive to manufacture and which is rugged and dependable in operation.

The novel features which I consider characteristic of my invention are set forth with particularity in the appended claims. The invention itself, however, both as to its organization and mode of operation, together with additional objects and advantages thereof, will best be understood from the following description of specific embodiments when read in connection with the accompanying drawings, in which:

Like reference characters indicate corresponding parts throughout the several views of the drawings.

Figure 1:
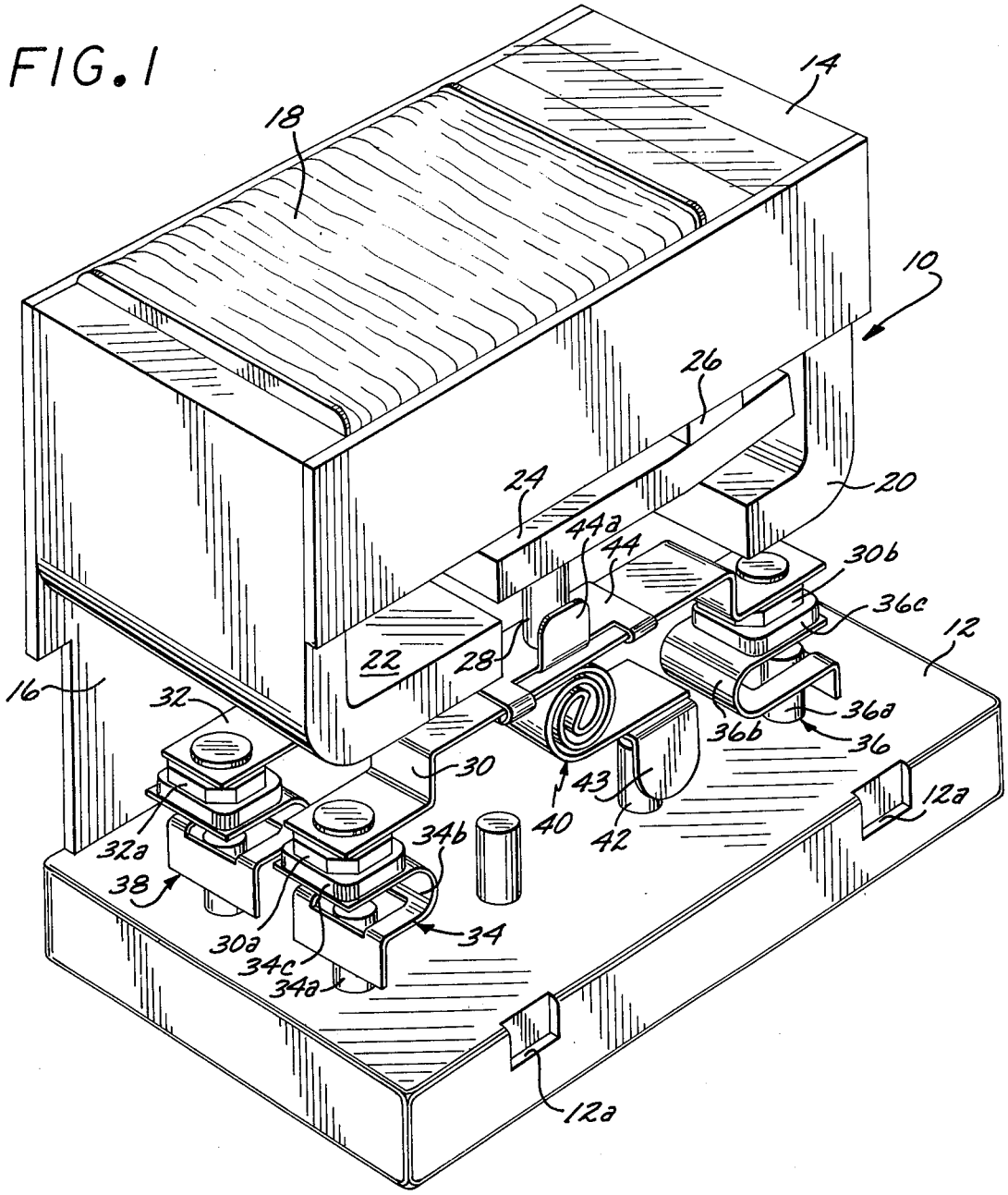
FIG. 1 is a perspective view of an electromagnetic switch having the subject electrically conductive moveable support member.

Referring to FIG. 1 of the drawings, there is shown therein an electromagnetic relay 10 having a base 12 on which is mounted an electromagnetic operator 14 by means of a support plate 16. Generally, such operator comprises an electromagnetic winding 18, to be energized from a suitable source of electrical power, one or more pole pieces 20 and 22 and a moveable armature 24. Another pole piece 26 is employed in the electromagnetic relay 10 shown in FIG. 1.

The armature 24 carries a mounting post 28 which, by means which will hereinafter be described, is connected to a pair of contactors 30 and 32. The opposite ends of contactor 30 are provided with contacts **30*a* and 30*b* which may be secured thereto by having a portion inserted through an opening in the respective end of contactor 30** which portion is upset to provide a unitary structure of the contactor and contacts.

A pair of stationary contact structures 34 and 36 are provided for cooperation, respectively, with the moveable contacts **30*a* and 30*b*, as shown in the drawings. Although the stationary contact structures may be formed in any appropriate manner, the stationary contact structure 34 is shown in the drawings as comprising a mounting post 34*a* to which is secured a generally U-shaped flexible support 34*b* which carries the stationary contact 34*c***.

The stationary contact structure 36 is formed in a like manner, having a mounting post **36*a*, a generally U-shaped flexible support 36*b*, and a stationary contact 36*c***.

The moveable contactor 32 is substantially identical with the contactor 30, above-described, and comprises a pair of moveable contacts **32*a* and 32*b* (not shown). Each such moveable contact cooperates with a stationary contact structure, one of which is shown at 38.**

The base 12, shown in FIG. 1 of the drawings, is formed with a pair of notches **12*a*** for receiving suitable mounting tabs on a cover (not shown) for completely encasing the switch structure.

The subject invention pertains to an electrically conductive moveable support member for use in an electrical switch. Such invention is not dependent upon the above-described electromagnetic relay for operability, but rather is of a universal nature such as to be applicable to virtually any type or kind of electrical switch. Further, the subject invention, as will be hereinafter described, can be used to support any one of various different parts and components of a relay which require both electrical energy and low torque moveability.

Figure 5:
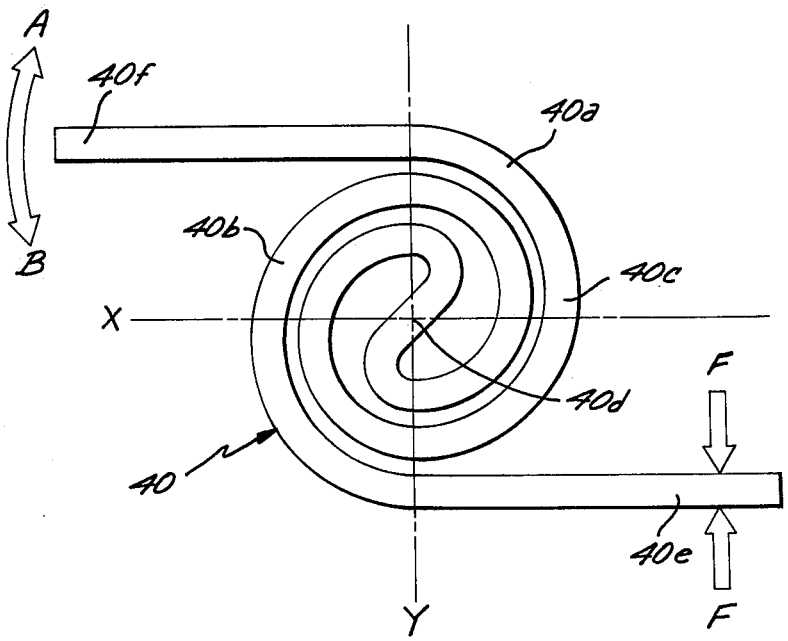
FIG. 5 is a side elevational view of the electrically conductive moveable support member.

Referring again to FIG. 1 of the drawings, the armature and contactors are supported by means of an electrically conductive moveable support member 40 which is formed as shown in FIG. 5 of the drawings. Member 40 is formed of an elongated strip **40*a*** of electrically conductive material having a uniform cross section throughout its length, sufficient to carry the amount of electrical current desired. Such material could be copper, aluminum, steel and the like, according to the electrical properties desired.

The elongated strip 40*a* is formed with a righthand convolution 40*b* and a left-hand convolution 40*c* on either side of the mid-point 40*d* of the length of such strip. As such, proceeding from end 40*e* toward end 40*f* of strip 40*a*, the strip is caused to be bent in a generally clockwise direction until the mid-point 40*d* is reached, and thereafter, the strip 40*a* is bent in a counterclockwise direction as end portion 40*f* is approached.

Figure 2:
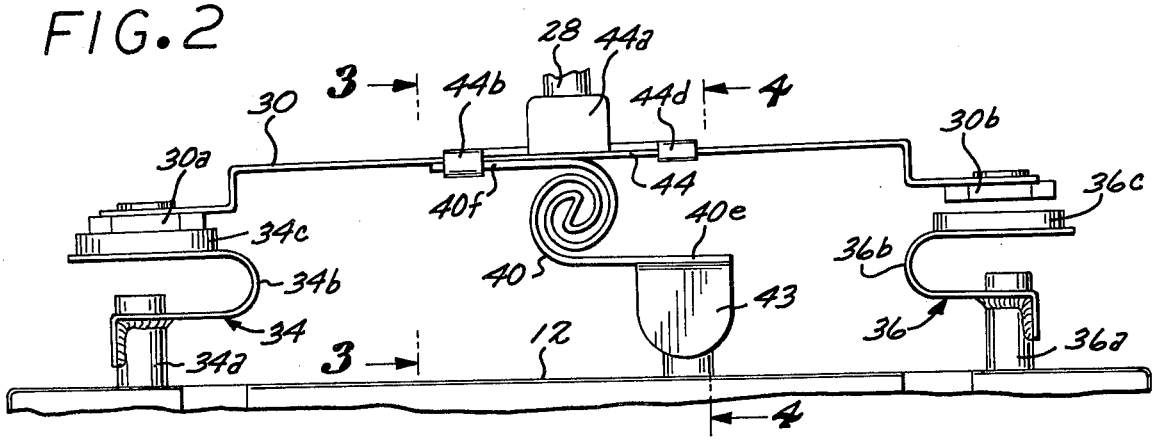
FIG. 2 is a fragmentary side elevational view of such relay, showing the support member.

The reversely formed convolutions 40*b* and 40*c*, as shown in FIGS. 1, 2 and 5 of the drawings, are interleaved such that the several convolutions are substantially adjacent to each other. This provides a compact unit which is substantially coplanar in construction for use in devices having limited available space.

End portion 40*e* of strip 40*a* is firmly secured to a mounting post or terminal 42. An L-shaped bracket 43 is welded to post 42 as shown at 46 in FIG. 3, and the end portion 40*e* of support member 40 is secured to bracket 43 in any appropriate manner as by welding, braising, soldering or the like, as shown at 48 in FIG. 4 of the drawings. Thus, as shown most clearly in FIGS. 1 and 2 of the drawings, the support member 40 is thus cantilevered from the mounting terminal post 42, the end portion 40*f* being secured to the contactors 30 and 32 and armature 24 in any appropriate manner.

Figure 3:
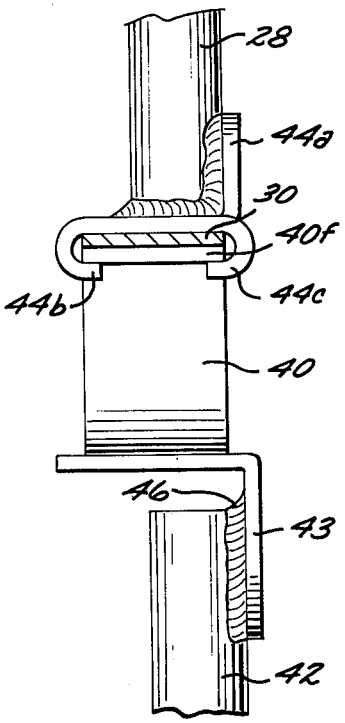
FIG. 3 is a transverse sectional view taken substantially along line 3—3 of FIG. 2 of the drawings.
Figure 4:
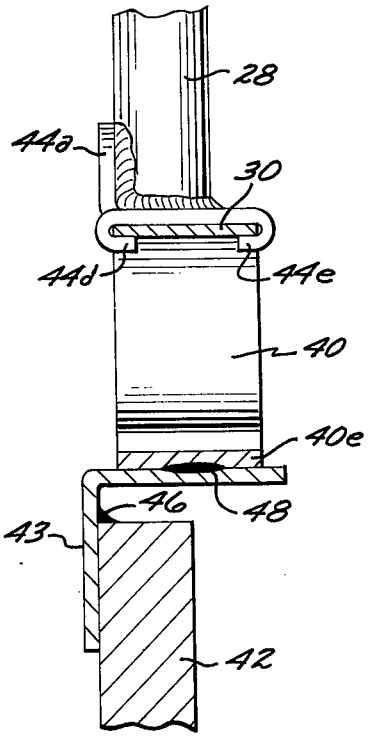
FIG. 4 is another transverse sectional view taken substantially along line 4—4 of FIG. 2 of the drawings.

Shown in FIGS. 1, 2, 3 and 4 of the drawings, is a mounting clip 44 formed of sheet material and provided with an upstanding arm 44*a* which, as shown in FIGS. 3 and 4, is secured to armature mounting post 28 by any appropriate means such as welding, braising, soldering and the like. Mounting clip 44 is further provided with four (4) reversely bent pads 44*b*, 44*c*, 44*d* and 44*e*. The latter two, namely tabs 44*d* and 44*e*, are caused to grip the contactor 30 along its opposite edges. The other tabs, namely tabs 44*b* and 44*c* circumvent and grip the edges of both the contactor 30 and the end portion 40*f* of support member 40. Such tabs can be firmly pinched or bent to strongly grip such members to thereby firmly secure the end portion 40*f* and contactor 30 to the armature mounting post 28.

Any appropriate type of clamping or fastening means, including the use of bolts, rivets and the like as well as welding, braising, soldering and the like, may be used to position support member 40 in a cantilever position. End portion 40*e* is anchored relative to a base member and the opposite end portion 40*f* is secured to the element, part or component to be moveably supported.

In the above-described environment, the support member 40 is part of the electrical circuit to be controlled by the opening and closing of moveable contacts 30*a* and 30*b* with their respective stationary contacts 34*c* and 36*c*. Also, support member 40 might be part of the electrical circuit through armature 24, if, if fact, the armature was caused to have electrical current flowing therethrough for a particular function.

Throughout such electrical conductivity afforded by support member 40, the armature and/or contactor 38 would be permitted to move as required by the various switch functions. Throughout such movement, very little bending would occur at any one cross section of the elongated strip 40*a* so that the electrical characteristics throughout its length would not change and also mechanical fatigue would not set in quickly. As a result, the moveable support member 40 will function satisfactorily for a great many cycles of operation over an extended period of time. Also, its mechanical, as well as electrical, characteristics will not change appreciably so that its operation is substantially constant over a long period of time and throughout successive operations or cycles.

The resistance to movement afforded by moveable support member 40 can be controlled to be very small. This is due to the fact that the elongated strip 40*a* is relatively long and thus its cantilever motion is distributed over a considerable length. Such relatively long strip, of course, is made compact by the aforedescribed convolutions as well as the interleaving of such convolutions 40*b* and 40*c*.

It is thus seen that the present invention provides an electrically conductive moveable support member for use in simultaneously carrying electrical current and in properly supporting a moveable member in an electrical switch.

Although I have shown and described certain specific embodiments of my invention, I am well aware that many modifications thereof are possible.

I claim:

1. An electrical switch comprising in combination, a base, a stationary contact fixed relative to said base, a moveable contactor having a moveable contact fixed thereto for cooperation with said stationary contact, motive power means operatively connected to said contactor for moving the latter, and an elongated strip of electrically conductive material formed with substantially equal right-hand and left-hand convolutions along its length and having one end connected relative to said base and another end connected to said contactor to thereby afford a cantilever member for said contactor during movement of said moveable contact between engaged and disengaged positions with said stationary contact, said cantilever member generating minimum resistance to such movement while conducting electrical energy.

2. An electrical switch, according to Claim 8, wherein said right-hand and left-hand convolutions are formed in opposite directions from substantially the mid-point of the length of said elongated strip.

3. An electrical switch, according to claim 2, wherein said elongated strip is formed with a substantially uniform cross section throughout its length.

4. An electrical switch, according to Claim 3, wherein the opposite end portions of said elongated strip are substantially parallel to provide the cantilever member for said contactor.

5. An electrical switch, according to claim 2, wherein said convolutions are substantially co-planar for minimum friction movement in parallel planes.

6. An electrical switch, according to claim 5, wherein said right-hand and left-hand convolutions are interleaved to form a composite unit.

* * * * *

UNITED STATES PATENT OFFICE
CERTIFICATE OF CORRECTION

Patent No. 4,005,298 Dated January 25,1977

Inventor(s) Jack H. Brown

It is certified that error appears in the above-identified patent and that said Letters Patent are hereby corrected as shown below:

Claim 2, line 1, "8" should read -- 1 --.

Signed and Sealed this

Thirty-first Day of May 1977

[SEAL]

*Attest:*

RUTH C. MASON
*Attesting Officer*

C. MARSHALL DANN
*Commissioner of Patents and Trademarks*